US005205759A

United States Patent [19]

Haderer

[11] Patent Number: 5,205,759

[45] Date of Patent: Apr. 27, 1993

[54] MOUNT FOR A PLUG/SOCKET COMBINATION

[75] Inventor: Johann Haderer, Dunsdorf, Fed. Rep. of Germany

[73] Assignee: Audi AG, Ingolstadt, Fed. Rep. of Germany

[21] Appl. No.: 793,415

[22] PCT Filed: May 25, 1990

[86] PCT No.: PCT/EP90/00839

§ 371 Date: Jan. 9, 1992

§ 102(e) Date: Jan. 9, 1992

[87] PCT Pub. No.: WO91/03083

PCT Pub. Date: Mar. 7, 1991

[30] Foreign Application Priority Data

Aug. 25, 1989 [DE] Fed. Rep. of Germany ..... 3928138

[51] Int. Cl.[5] ..... H01R 13/74

[52] U.S. Cl. ..... 439/545; 248/225.1

[58] Field of Search ..... 248/220.2, 225.1; 439/545-549, 552, 557

[56] References Cited

U.S. PATENT DOCUMENTS

| | | | |
|---|---|---|---|
| 3,706,066 | 12/1972 | Shroyer | 439/552 |
| 4,389,021 | 6/1983 | Coldren | 439/545 |
| 4,780,090 | 10/1988 | Sugiyama et al. | 439/540 |
| 4,829,564 | 5/1989 | Jarvis | 439/540 |
| 4,934,943 | 6/1990 | Klein et al. | 439/547 |

FOREIGN PATENT DOCUMENTS 3605063 10/1987 Fed. Rep. of Germany .

OTHER PUBLICATIONS

IBM Technical Disclosure Bulletin, "Connector for Printed Circuit", vol. 32, No. 5B, Oct. 1989.

*Primary Examiner*—Gary F. Paumen

*Attorney, Agent, or Firm*—Lalos & Keenan

[57] ABSTRACT

A connector/socket combination to be installed in a motor vehicle. The combination includes a socket with a slot on two opposing sides thereof, a connector and a holder. The holder includes at least two webs for receiving the socket therebetween, and a projection on at least one end of the two webs. The webs are positioned within the slots of the socket and the projection engages the connector after the connector has been joined to the socket, whereby the socket and connector are immobilized by the holder.

6 Claims, 1 Drawing Sheet

MOUNT FOR A PLUG/SOCKET COMBINATION

The invention relates to a holder for a connector/-socket combination that can be installed in a motor vehicle.

These kinds of holders are state of the art, for example, in the field of engine sensors, plug-type connectors intended to be used for repair purposes or for changing the sensors. The plug-type connectors formed from a connector/socket combination are mounted, with the plug and socket usually being connected to each other by latch connections.

Shaking and vibrations in the engine area require a secure connection.

SUMMARY OF THE INVENTION

The object of the invention is to provide a simple fastening of the connector/socket combination in the holder.

According to the invention, an element of the connector/socket combination, i.e., the connector or the socket, is inserted into the holder in a conventional manner. The holder encompasses the element with forks or tongs in such a way that the holder fits into a slot so as to allow the element to be connected perpendicular to the holder. Immobilization is also necessary, however, in the direction of insertion so that the element does not slide out of its encompassing fork or tongs in the direction opposite to its insertion.

According to the invention, this will be accomplished in a simple manner so that the end of at least one of the webs encompassing the element is bent. The companion piece to the element inserted into the holder, i.e., the connector to the socket or the socket to the connector, is broad enough to lie beneath the bend of the web after being inserted and consequently presses against it when the element is moved from the tong shaped insertion in the opposite direction to the initial direction again. As long as the connector/socket combination is joined together, it cannot come apart by itself.

Because the connector and socket are latched together it is impossible to unintentionally o accidentally break the connection or to remove it from the holder.

Other objects and advantages of the present invention will become more apparent to those persons having ordinary skill in the art to which the present invention pertains from the following description taken in conjunction with the accompanying drawings.

DETAILED DESCRIPTION

Figure 1:
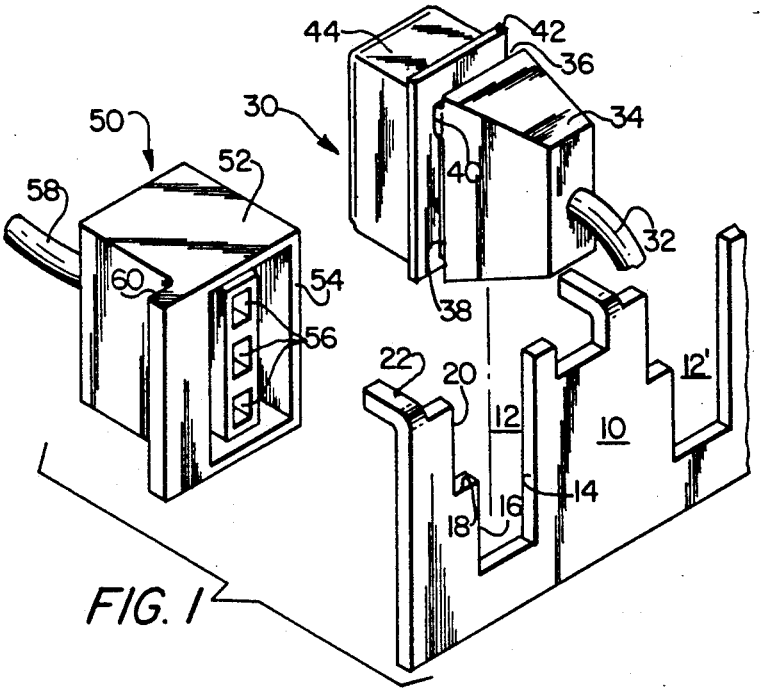
FIG. 1 shows the holder and separated connector and socket.
Figure 2:
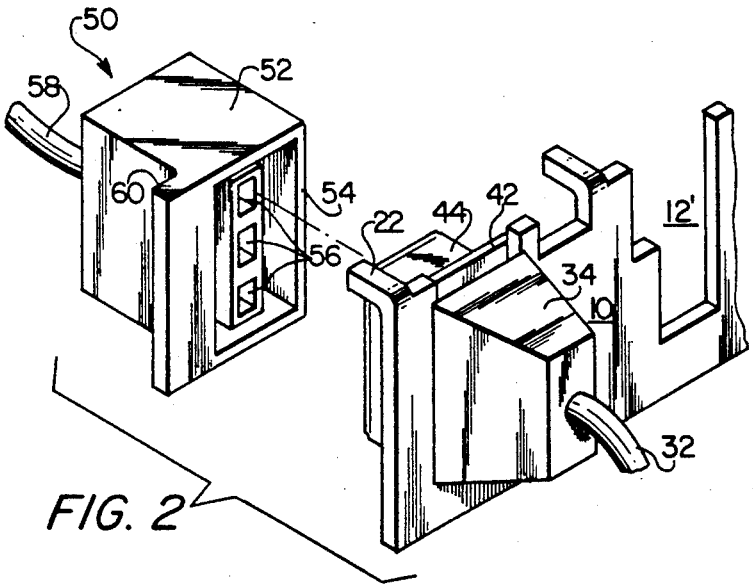
FIG. 2 shows the holder with attached connector without a plugged-in socket.
Figure 3:
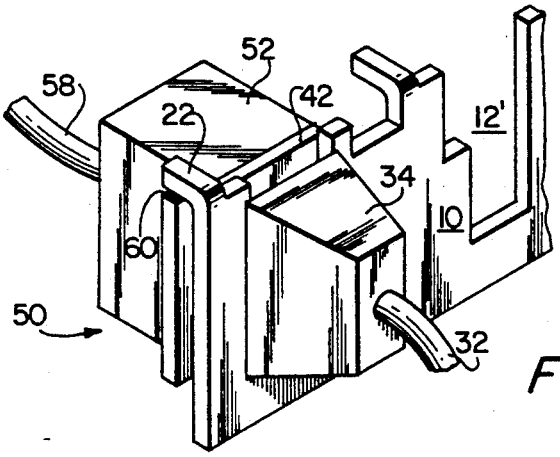
FIG. 3 shows the holder with attached connector and plugged-in socket.

Referring to the drawings, a holder 10 is shown that is primarily made of metal strips, including a notch 12. Notch 12 is bordered at the sides by the two webs 14 and 16. Web 16 includes a step portion 18 to create an enlarged area 20 of notch 12. The upper end of the web 16 includes a projection 22 perpendicular to the surface of strip 10.

Strip 10 may include a plurality of notches 12, 12', corresponding to the number of connector/socket combinations requiring a holder.

A socket 30 is provided having an electric cable 32 in its rearward side in a conventional manner. A slot 36, with a width that corresponds to the inner width of notch 12, connects to an intermediate section 34 which in turn is connected to cable 32. To ensure that the socket is inserted correctly, a projection 40 is provided on a side 38, the projection 40 corresponding to step portion 18 of notch 12.

Slot 36 is contained at the front by a plate 42 that abuts the holder in two dimensions when the socket is plugged in. A guide component 44 encompasses the socket contacts and enables a secure insertion of connector 50 in that guide component 44 is received into a housing 54 of the connector.

The width of plate 42 is constructed in such a way that upon insertion, plate 42 slides by projection 22, allowing socket 30 to be inserted and extracted from section 12 without interference from projection 22.

The width of connector 50 is constructed in such a way that upon insertion, with contacts 56 being inserted into the corresponding opening in the socket, an upper extension 60 of upper side 52 rests under projection 22. Connector 50 is therefore wider than socket 30 and when fully assembled with socket 30 projection 22 keeps the connector/socket combination from moving upwards, because projection 22 presses against upper extension 60.

The socket can only be taken out of notch 12 when the connector 50 has been previously removed.

Because, as is usual for state of the art, connector 50 and socket 30 are fastened together by an appropriate latch mechanism, not shown, an unintentional separation is impossible, and for the same reason the connector/socket combination 10 cannot come out of the holder.

Of course, the connector and socket elements for the holder are replaceable, and in exactly the same manner the connector can be secured, with the wider socket coming to rest under the projection 22 in a plugged-in position and therefore securing the combination from upward movement.

It is evident that there are a number of adaptations of the present invention coming within the province of those persons having ordinary skill in the art to which the present invention pertains. For instance, it is possible to secure other elements having plug-type connectors, including but not limited to sensors, lamps and display elements. It is intended that all such variations not departing from the spirit of the invention be considered as within the scope thereof as limited solely by the appended claims.

I claim:

1. A connector/socket combination to be installed in a motor vehicle comprising:

a first element including a slot on two opposing sides thereof;

a second element; and a holder, said holder including at least two webs for receiving the first element therebetween, and a projection extending from and perpendicular to at least one end of one of said at least two webs, said webs being positioned within said slots of said first element, said projection engaging said second element after said second element has been joined to said first element, whereby said first and second elements are immobilized by said holder.

2. The holder according to claim 1, wherein said projection points in the direction toward said second element.

3. The holder according to claim 1, wherein said first element includes a cable, said projection pointing in the direction away from said cable.

4. The connector/socket combination according to claim 1, wherein said first element is the socket and said second element is the connector.

5. The connector/socket combination according to claim 1, wherein said second element includes a surface projecting from a side and perpendicular to a front face thereof, said surface contacting said holder projection.

6. The connector/socket combination according to claim 1, wherein one of said at least two webs includes a step portion, and said first element slot includes a projecting means thereon for engaging said web step portion.

* * * * *